US012484698B1

(12) United States Patent
Lamoureux

(10) Patent No.: US 12,484,698 B1
(45) Date of Patent: Dec. 2, 2025

(54) PORTABLE STOOL

(71) Applicant: Derick Lamoureux, South Hadley, MA (US)

(72) Inventor: Derick Lamoureux, South Hadley, MA (US)

( * ) Notice: Subject to any disclaimer, the term of this patent is extended or adjusted under 35 U.S.C. 154(b) by 179 days.

(21) Appl. No.: 18/393,018

(22) Filed: Dec. 21, 2023

(51) Int. Cl.

| | |
|---|---|
| ***A47C 3/18*** | (2006.01) |
| ***A47C 3/20*** | (2006.01) |
| ***A47C 3/36*** | (2006.01) |
| ***A47C 7/62*** | (2006.01) |

(52) U.S. Cl.
CPC ..... *A47C 3/185* (2013.01); *A47C 3/20* (2013.01); *A47C 3/36* (2013.01); *A47C 7/626* (2018.08)

(58) Field of Classification Search
CPC ..... A47C 3/185; A47C 7/626; A47C 3/36; A47C 3/20
See application file for complete search history.

(56) References Cited

U.S. PATENT DOCUMENTS 2,225,735 A * 12/1940 Nils ..... A47C 3/185 248/417
2,329,697 A * 9/1943 Herman ..... A47C 3/185 248/417
2014/0292053 A1* 10/2014 Chou ..... A47C 3/185 297/344.21

FOREIGN PATENT DOCUMENTS

| | | | | |
|---|---|---|---|---|
| KR | 860001882 Y1 * | 8/1986 | ..... | A47C 3/185 |
| KR | 890000679 Y1 * | 3/1989 | ..... | A47C 3/185 |
| KR | 200431275 Y1 * | 11/2006 | ..... | A47C 3/185 |
| KR | 102088738 B1 * | 3/2020 | ..... | A47C 7/626 |

* cited by examiner

*Primary Examiner* — Milton Nelson, Jr.
(74) *Attorney, Agent, or Firm* — Gulf Coast Intellectual Property Group

(57) ABSTRACT

A portable stool that is configured to provide support for a user in an upright position wherein the present invention further provides controlled rotational movement for the user. The present invention includes a seat member wherein the seat member is supported by leg members. The leg members are adjustable in length and placed at an angle so as to angularly position the seat member at an angle of approximately thirty degrees when the portable stool is in its deployed state. The seat member includes a base member wherein the base member is rotationally coupled to a top portion of the seat member. Movement members are operably coupled to the base member and top portion of the seat member and provide a biased return to a neutral position ensuing the top portion of the seat member being rotatably moved. Light modules are present on the leg members.

16 Claims, 3 Drawing Sheets

PORTABLE STOOL

FIELD OF THE INVENTION

The present invention relates generally to sitting apparatus, more specifically but not by way of limitation, a portable stool that is configured to be deployed for various uses and in alternate locations wherein the present invention provides various safety features as well as a rotatable seat member.

BACKGROUND

Various professional careers require those involved therein to remain on their feet for extended periods of time. Positions such as but not limited to traffic police officers can be on their feet for hours without a break. The standing required for these types of jobs can result in worker fatigue, lower back pain and pain in other areas such as but not limited to foot pain. While most of these workers will typically invest in a high quality shoe to address some of the aforementioned issues, the shoes are unable to completely remove all of the physical inconvenience of performing the job duties.

Some professions will try to incorporate various support apparatus such as but not limited to stools or other chairs but these conventional sitting implements are often deficient in delivering enough utility for the professions. Flaggers and police officers will often have additional equipment such as but not limited to flashlights, flags and other items that require handling and storage. Conventional sitting implements are not configured to assist in handling of these objects. Additionally, for applications such as but not limited to traffic direction, conventional sitting apparatus do not have elements beneficial for such applications such as but not limited to safety lighting. Furthermore, conventional sitting apparatus are not configured to facilitate various body movements such as but not limited to rotational movements.

Accordingly, there is a need for a sitting apparatus that is configured to be deployed for various applications such as but not limited to traffic direction wherein the present invention is operable to provide features such visual safety, user support and movement and further include handling of handheld elements.

SUMMARY OF THE INVENTION

It is the object of the present invention to provide a portable stool that is configured to provide support for a user wherein the present invention includes a seat member having legs operably coupled thereto wherein the legs are pivotally mounted to the seat member and are telescopic.

Another object of the present invention is to provide a portable sitting apparatus that is configured to be deployed for applications such as but not limited to traffic direction wherein the seat member of the present invention includes a rotatable portion.

A further object of the present invention is to provide a portable stool that is configured to provide support for a user wherein the seat member includes a biasing members that provide controlled rotation of the upper seat portion.

Yet a further object of the present invention is to provide a portable sitting apparatus that is configured to be deployed for applications such as but not limited to traffic direction wherein the present invention includes at least one implement retention member configured to receive and store a handheld implement.

Still another object of the present invention is to provide a portable stool that is configured to provide support for a user wherein the leg members of the present invention further include high visibility lights.

An additional object of the present invention is to provide a portable sitting apparatus that is configured to be deployed for applications such as but not limited to traffic direction wherein the seat member is placed in an angular orientation when the portable sitting apparatus is in its deployed position.

Yet a further object of the present invention is to provide a portable stool that is configured to provide support for a user wherein the present invention includes an integrated power supply and at least one charging port.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
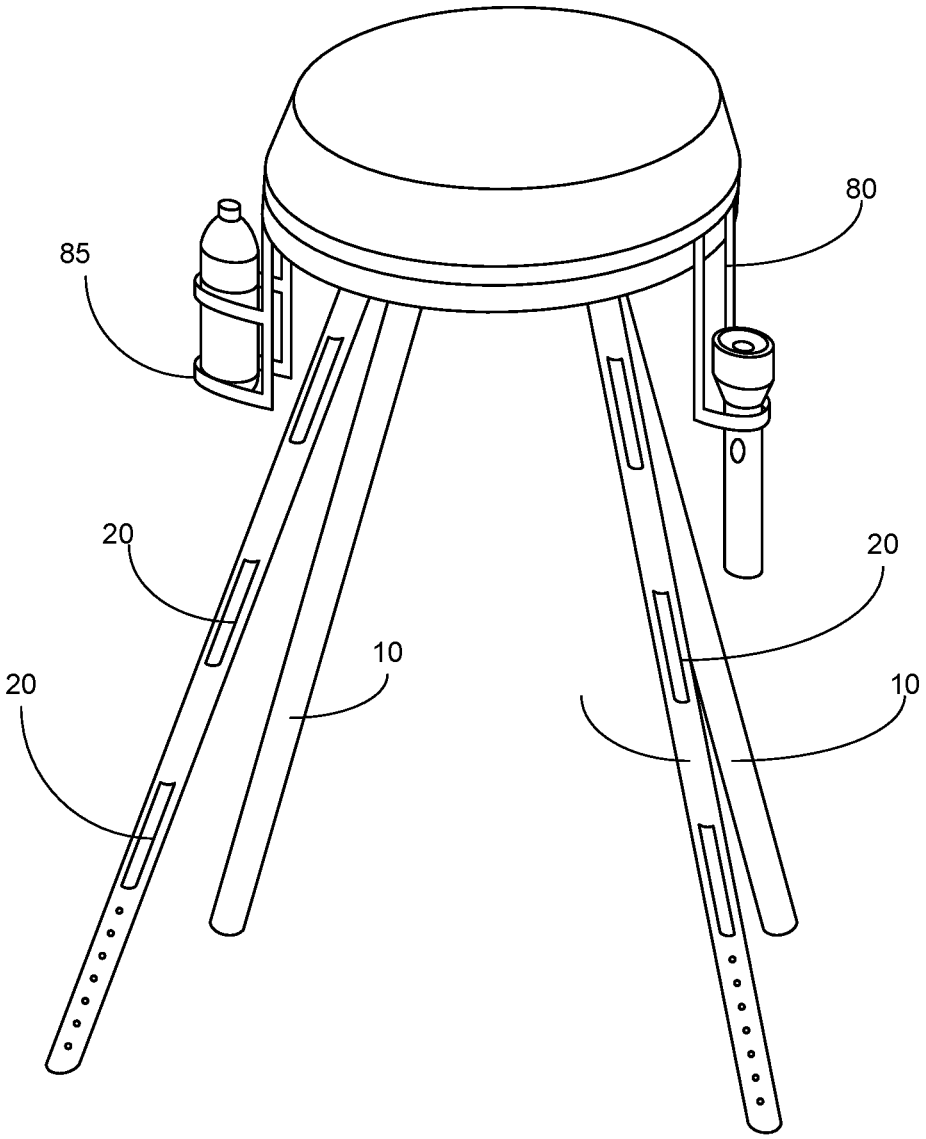
FIG. 1 is a perspective view of the present invention in its deployed state.

Referring now to the drawings submitted herewith, wherein various elements depicted therein are not necessarily drawn to scale and wherein through the views and figures like elements are referenced with identical reference numerals, there is illustrated a portable stool 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the portable stool 100 includes leg members 10. Leg members 10 include a first end 11 and a second end 12 and in a preferred embodiment are manufactured to be adjustable in length. It should be understood within the scope of the present invention that the leg members 10 could be manufactured utilizing numerous techniques to achieve the desired functionality of being adjustable in length. The leg members 10 includes light modules 20 integrally formed therewith. The light modules 20 in a preferred embodiment are high visibility LED lights that can be configured to illuminate in alternate colors. The light modules 20 are operable to be employed for certain use applications of the portable stool 100 such as but not limited to road side applications. While the portable stool 100 has six light modules 20 illustrated herein, it should be understood within the scope of the present invention that the portable stool 100 could have as few as one light module 20 or more than six light modules 20. Furthermore, it should be understood within the scope of the present invention that the light modules 20 could be manufactured in alternate sizes and shapes. While the portable stool 100 is illustrated herein as having four leg members 10, it is contemplated within the scope of the present invention that the portable stool 100 could be manufactured with fewer or more than four leg members 10.

The first end 11 of the leg members 10 are operably coupled to the connection members 25 that are secured to the bottom surface 31 of the base portion 30 of the seat member 40. The connection members 25 are formed to have a portion of the leg member 10 journaled thereinto. In a preferred embodiment the connection members 25 are manufactured from C-channel metal and include a pivot pin member 26 that facilitates the pivotal movement of the leg members 10. While a C-channel shape is preferred, it should be understood within the scope of the present invention that the connection members 25 could be manufactured in alternate shapes and sizes in order to achieve the desired objective discussed herein. The connection members 25 further include apertures 27,28 that are operable to have a pin or similar element journaled thereinto engaging the upper end of the leg member 10 to retain in either the deployed or stored position. While not particularly illustrated herein, it is contemplated within the scope of the present invention that the upper ends of the leg member 10 would have an aperture or similar element to operably engage a pin or similar type fastener.

Figure 2:
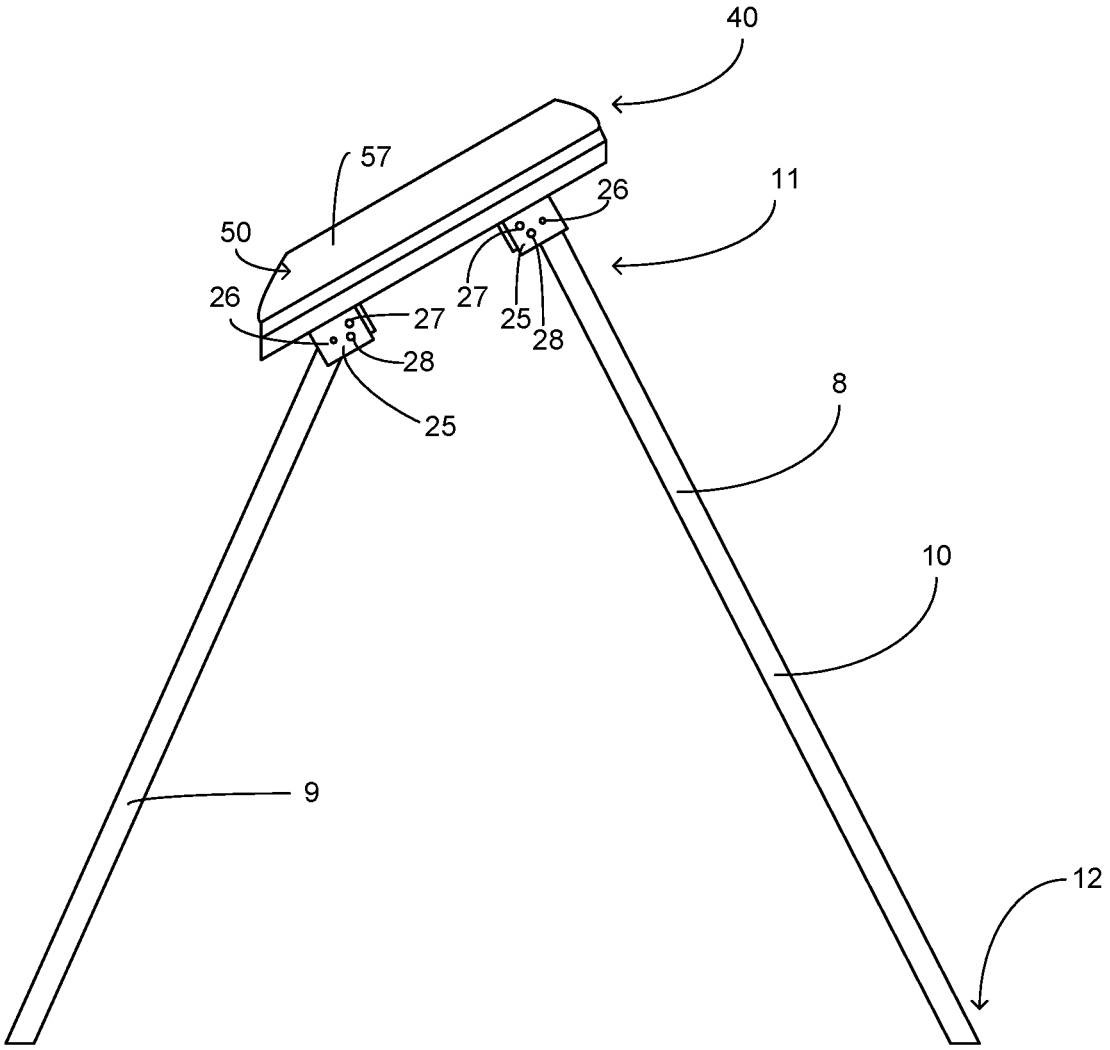
FIG. 2 is a side view of the present invention in its deployed state.
Figure 3:
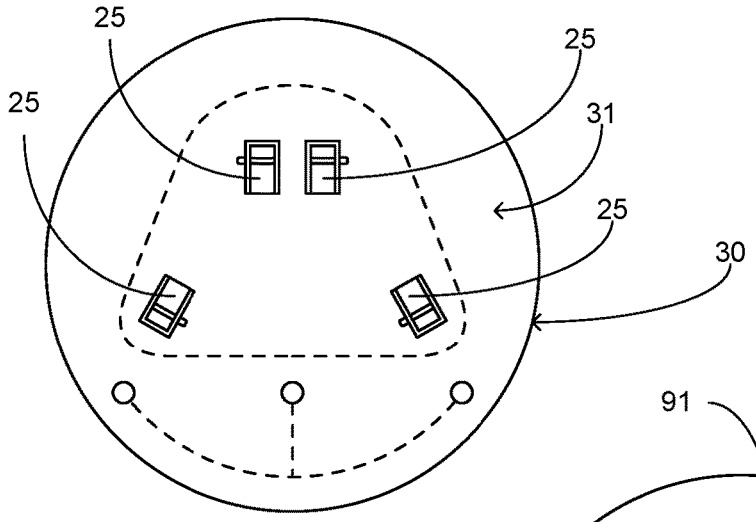
FIG. 3 is a bottom view of the base portion of the seat member of the present invention.
Figure 4:
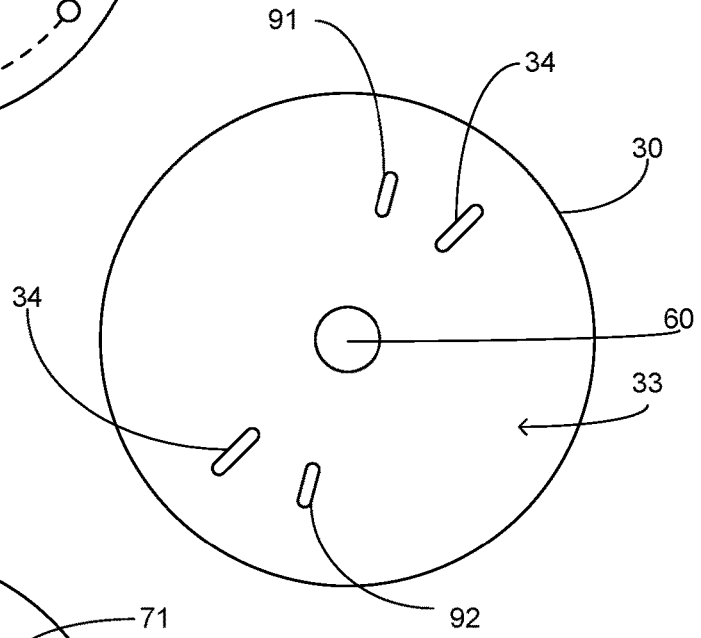
FIG. 4 is a top view of the base portion of the seat member of the present invention.
Figure 5:
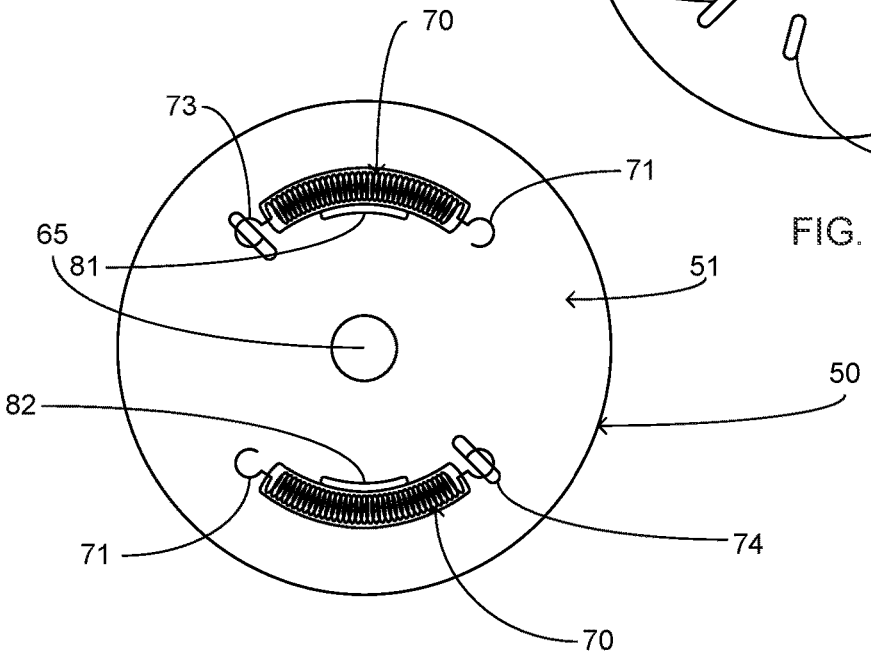
FIG. 5 is a bottom view of the upper portion of the seat member of the present invention.

The connection members 25 have the leg members 10 movably coupled thereto so as to facilitate the positioning of the leg members 10 in the angular orientation as is illustrated herein in FIG. 2. The front leg members 9 are positioned so as to be at an obtuse angle with respect to the seat member 40 wherein the rear leg members 8 are positioned by the connection members 25 to be generally perpendicular to the seat member 40 when the portable stool 100 is in its deployed state. The aforementioned angles of the seat member 40 placed the seat member 40 at an angle of approximately thirty degrees. The angular orientation of the seat member 40 is preferred for the desired applications of the portable stool 100 wherein the angular orientation of seat member 40 allows the user to be supported while in a modified standing position. While the preferred angle of the seat member 40 is thirty degrees, it should be understood within the scope of the present invention that the seat member 40 could be oriented at alternate angles in order to achieve the desired objective discussed herein.

The seat member 40 includes a base portion 30 having a top portion 50 rotatably coupled thereto. The top portion 50 includes padded section 57 configured to have a user superposed thereon. The upper surface 33 of the base portion 30 has apertures 34 formed therein wherein the apertures 34 are opposedly located with respect to the mounting member 60. The apertures 34 are configured to be operably coupled to the ends 71 of the movement members 70 in order to facilitate rotational movement of the top portion 50 as is further discussed herein. The mounting member 60 is annular in shape and is operably coupled to the mounting member 65 so as to facilitate a rotatable connection between the base portion 30 and top portion 50. It should be understood the rotatable movement between the base portion 30 and top portion 50 could be accomplished employing various alternate elements. The movement members 70 are secured to the bottom surface 51 of the top portion 50 wherein the ends 73,74 are opposedly located with respect to the mounting member 65. The movement members 70 have adjacently mounted thereto guide members 81,82. The guide members 81,82 provide directional support for the movement members 70 ensuring the maintenance of the shape thereof so as to enable proper movement of the top portion 50. Protruding upward from the upper surface of the base portion 30 are rotational limit members 91,92. The rotational limit members 91, 92 are manufactured from a rigid material such as but not limited to metal and are operable to limit the rotational travel distance of the top portion 50.

The aforementioned location of the ends 73,74 facilitate a biased rotational movement towards a neutral position of the top portion 50. As a user operates the seat member 40, a clockwise rotation or counterclockwise rotation is performed wherein the movement members 70 will expand to permit either rotational movement. The movement members 70 apply a bias force subsequent expansion so as to facilitate a return to a neutral position wherein both movement members 70 are contracted and no expansion force is imposed thereon. Depending on the direction of the rotation, a movement member 70 will be extended and as such upon a desire to return to the starting neutral position the movement member will facilitate the return rotational movement with little to no effort required by the user of the portable stool 100. While the movement members 70 are illustrated herein as springs, it should be understood within the scope of the present invention that the movement members 70 could be manufactured from various alternate elements configured to provide the desired functionality described herein. While two movement members 70 are illustrated and discussed herein, it is contemplated within the scope of the present invention that the portable stool 100 could employ less than two movement members 70 or more than two movement members 70 in order to facilitate the desired rotational movement discussed herein.

The portable stool 100 further includes retention members 80, 85. The retention members 80,85 are operably coupled to the seat member 40 extending downward therefrom. The retention members 80,85 are manufactured from a lightweight durable material such as but not limited to plastic. The retention members 80,85 include support members that are arranged in a manner so as to receive and store items such as but not limited to flashlights and beverage containers. It should be understood within the scope of the present invention that the retention members 80,85 could be manufactured in numerous alternate shapes and sizes in order to receive and store various different items. While not particularly illustrated herein, it is contemplated within the scope of the present invention that the portable stool 100 includes an integrated power supply that is configured to provide power for the light modules 20 as well as supply power for accessories such as but not limited to USB charging ports (not illustrated herein). While the seat member 40 has been illustrated herein as being annular in shape, it is contemplated within the scope of the present invention that the seat member 40 could be provided in alternate shapes and sizes.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A portable stool configured to assist with rotational movement of a user wherein the portable stool comprises:

a seat member, said seat member having a base portion, said base portion having a lower surface and an upper surface, said seat member having a top portion, said top portion being operably coupled to said upper surface of said base portion, said top portion having a lower surface and an upper surface, said top portion being rotatably movable with respect to said base portion;

at least one leg member, said at least one leg member being operably coupled to said lower surface of said base portion, said at least one leg member being adjustable in length, said at least one leg member being hingedly coupled to said lower surface of said base portion; and at least one movement member, said at least one movement member being intermediate said base portion and said top portion of said seat member, said at least one movement member configured to provide movement control to return the top portion to a starting position subsequent rotational movement thereof.

2. The portable stool configured to assist with rotational movement of a user as recited in claim 1, wherein said at least one movement member includes a first end and a second end, said first end operably coupled to said lower surface of said top portion, said second end being operably coupled to said upper surface of said base portion.

3. The portable stool configured to assist with rotational movement of a user as recited in claim 2, wherein said base portion further includes an aperture, said aperture being operably coupled to said second end of said at least one movement member.

4. The portable stool configured to assist with rotational movement of a user as recited in claim 3, and further including at least one retention member, said at least one retention member being operably coupled to said seat member extending downward therefrom, said at least one retention member configured to receive and retain an object therein.

5. The portable stool configured to assist with rotational movement of a user as recited in claim 4, and further including a connection member, said connection member being secured to said lower surface of said base portion, said connection member being configured to receive an end of said at least one leg member.

6. The portable stool configured to assist with rotational movement of a user as recited in claim 5, wherein said at least one leg member includes a light module, said light module being elongated in shape.

7. The portable stool configured to assist with rotational movement of a user as recited in claim 6, wherein said upper surface of said base portion includes a mounting member extending upward therefrom and being centrally located on said base portion, said mounting member configured to operably couple to a mounting member present on said lower surface of said top portion.

8. A portable stool configured to provide biased assistance to rotationally turn a user to a starting position ensuing a first turning movement wherein the portable stool comprises:

a seat member, said seat member having a base portion, said base portion having a lower surface and an upper surface, said base portion having a top portion operably coupled thereto, said top portion having a lower surface and an upper surface, said top portion being rotatably movable with respect to said base portion, said base portion having a first mounting member present in a center thereof, said first mounting member configured to be operably coupled to a second mounting member present on the lower surface of said top portion, said base portion having a first aperture and a second aperture, said first aperture and said second aperture being located on opposing sides of said first mounting member;

four leg members, said four leg members consisting of a first pair and a second pair, said first pair of said four leg members being adjacent each other and generally parallel, said second pair of said four leg members being adjacent each other and opposedly located from said first pair, said four leg members being hingedly coupled to said lower surface of said base portion with connection members, said four leg members being adjustable in length;

a first movement member and a second movement member, said first movement member and said second movement member having a first end and a second end, said first end of said first movement member and said second movement member being operably coupled to said lower surface of said top portion, said second end of said first movement member and said second movement member being operably coupled to said first aperture and said second aperture respectively, said first movement member and said second movement member configured to provide a bias force to return the seat member to the starting position ensuing rotational movement of the top portion of the seat member.

9. The portable stool configured to provide biased assistance to rotationally turn a user to a starting position ensuing a first turning movement as recited in claim 8, wherein said connection members coupling said first pair of said four leg members are configured to place said first pair at an obtuse angle with respect to said base portion.

10. The portable stool configured to provide biased assistance to rotationally turn a user to a starting position ensuing a first turning movement as recited in claim 9, wherein said connection members operably coupling said second pair of said four leg members are configured to place said second pair at a perpendicular angle with respect to said base portion.

11. The portable stool configured to provide biased assistance to rotationally turn a user to a starting position ensuing a first turning movement as recited in claim 10, wherein in a deployed state of the portable stool said seat member is placed in an angular orientation.

12. The portable stool configured to provide biased assistance to rotationally turn a user to a starting position ensuing a first turning movement as recited in claim 11, wherein said first movement member and said second movement member are springs.

13. The portable stool configured to provide biased assistance to rotationally turn a user to a starting position ensuing a first turning movement as recited in claim 12, wherein said four leg members further include at least one light module, said at least one light module being elongated in shape.

14. The portable stool configured to provide biased assistance to rotationally turn a user to a starting position ensuing a first turning movement as recited in claim 13, and further including at least one retention member, said at least one retention member being operably coupled to said seat member extending downward therefrom, said at least one retention member configured to receive and retain an object therein.

15. The portable stool configured to provide biased assistance to rotationally turn a user to a starting position ensuing a first turning movement as recited in claim 14, and further including a first guide member and a second guide member, said first guide member and second guide member being mounted adjacent to the first movement member and second movement member respectively, said first guide member and said second guide member operable to maintain a shape and orientation of the first movement member and the second movement member.

16. The portable stool configured to provide biased assistance to rotationally turn a user to a starting position ensuing a first turning movement as recited in claim 15, and further including two rotational limit members, said two rotational limit members protruding upward from the upper surface of the base portion, said two rotational limit members operable to limit a rotational travel distance of the top portion.

* * * * *